United States Patent [19]

Alson et al.

[11] Patent Number: 4,933,025

[45] Date of Patent: Jun. 12, 1990

[54] METHOD FOR ENHANCING MAGNETIC PROPERTIES OF RARE EARTH PERMANENT MAGNETS

[75] Inventors: Erwin A. Alson, Fraser; Thomas H. VanSteenkiste, Washington, both of Mich.

[73] Assignee: General Motors Corporation, Detroit, Mich.

[21] Appl. No.: 415,696

[22] Filed: Oct. 2, 1989

[51] Int. Cl.[5] ..... H01F 1/02

[52] U.S. Cl. ..... 148/104; 148/105; 419/62; 419/63; 419/64; 419/65; 209/173

[58] Field of Search ..... 148/104, 105; 419/62, 419/63, 64, 65; 209/172.5, 173, 175

[56] References Cited

U.S. PATENT DOCUMENTS 4,496,395 1/1985 Croat ..... 148/301

4,792,367 12/1988 Lee ..... 148/104

4,802,931 2/1989 Croat ..... 148/302

*Primary Examiner*—John P. Sheehan

*Attorney, Agent, or Firm*—George A. Grove

[57] ABSTRACT

A method for treating rare earth permanent magnetic material is disclosed. The treatment includes soaking ribbon rare earth permanent magnetic material consisting essentially of grains of the tetragonal crystal phase $RE_2TM_{14}B$ where RE is neodymium and/or praseodymium or mixtures thereof with other rare earth elements and TM is iron or mixtures of iron and cobalt, cobalt in a soaking solution of either distilled water or phosphoric acid and manganese phosphate solution, draining off the soaking solution, rinsing with distilled water while agitating to separate and remove fine powdered magnetic material, and washing and drying the remaining powder or ribbons. The treated material is taken to substantial dryness before the material is incorporated into a permanent magnet.

12 Claims, 2 Drawing Sheets

METHOD FOR ENHANCING MAGNETIC PROPERTIES OF RARE EARTH PERMANENT MAGNETS

TECHNICAL FIELD

This invention relates to a treatment of permanent magnetic material. More particularly, this invention relates to enhancing the magnetic properties by soaking and washing magnetic compositions comprising iron, neodymium and/or praseodymium and boron in distilled water or a solution containing phosphoric acid and manganese phosphate.

BACKGROUND

Recently, rare earth element-containing compounds have been investigated for permanent magnets. Such magnets are currently being produced for various applications. For example, a high energy product, high coercivity permanent magnet composition comprising iron, neodymium and/or praseodymium and boron and the methods of making the same are disclosed in U.S. Pat. No. 4,496,395 issued Jan. 29, 1985 and U.S. Pat. No. 4,802,931 issued Feb. 7, 1989, both to John J. Croat and assigned to the assignee of this application. In those patents, magnetically hard compositions having high values of coercivity, remanence and energy product contain rare earth elements, transition metal elements and boron in suitable proportions. Melt-spun ribbons of the permanent magnetic material are disclosed as well as methods of making the same.

Furthermore, U.S. Pat. No. 4,792,367 issued Dec. 20, 1988 to Robert W. Lee, again assigned to the assignee of this application, discloses a high energy product, magnetically anisotropic permanent magnet which is produced by hot working quenched or fine grained, melt-spun materials comprising iron, neodymium and/or praseodymium and boron to produce a fully densified, fine grained body which has undergone plastic flow.

In the past, samarium cobalt magnets were the preferred permanent magnets. However, low availability of the raw materials has prompted research into other arenas of material science. Consequently, magnets having grains of a predominant atomic formula of $Nd_2Fe_{14}B_1$ are being investigated. These magnets may be made from more readily available materials, without substantially sacrificing the magnetic performance. Thus, great initiative has been placed into researching ways and methods of optimizing the performance of the $Nd_2Fe_{14}B_1$ magnetic materials.

In order to make neodymium-iron-boron magnetic materials commercially feasible, there are certain problems which require attention. These include (1) increasing the useful service life of the material and (2) rejuvenating materials which have degraded over time after exposure to atmospheric conditions. In addition, neodymium-iron-boron magnets have traditionally shown a somewhat low crush strength and a relatively intolerant resistance to corrosion. Consequently, these problems have been investigated and addressed by the present inventors during the course of their research.

The conventional neodymium-iron-boron magnets are limited in that they exhibit decreased magnetic properties over time due to the degradation of the materials. They have exhibited a relatively low crush strength and a commensurate low resistance to corrosion. The methods which have been used to produce such magnets had been acceptable, although there was room for improvement. The current research has been directed towards increasing the remanent moment, Br, and the intrinsic coercivity, Hci, of the magnetic materials.

It has been recognized that neodymium-iron-boron magnetic materials may be produced by melt spinning, such as the materials which are disclosed in the above-mentioned U.S. Pat. No. 4,496,395 issued Jan. 25, 1985 to John J. Croat. The materials referenced above in U.S. Pat. No. 4,802,931 entitled "High Energy Product Rare Earth-Magnet Alloys" relates to alloying mixtures of one or more transition metals and one or more rare earth elements. The alloys are quenched from a molten state at a controlled rate and thereafter solidified to produce finely grained crystalline microstructures.

As discussed above, it would be advantageous to restore the magnetic properties of these melt-spun materials lost due to degradation over time. It would also be advantageous to increase the crush strength of the resulting magnets as well as to increase the resistance to corrosion. Therefore, it is an object of our invention to provide a method of treatment for the magnetic compositions to effect a partial revival of the original magnetic properties of the material, to increase the crush strength and to increase the corrosion resistance of the material.

It is another object of our invention to provide methods for enhancing the properties of the magnetic materials utilizing techniques which are simple, relatively quick, non-toxic, and particularly effective. It is also to be recognized that the cost of such a method must be sufficiently low such that it is economically feasible to utilize such a method without adding substantially to the overall lifetime cost of the permanent magnet.

BRIEF SUMMARY

In accordance with the preferred methods of our invention, these and other objects and advantages are accomplished as follows.

Methods are disclosed herein which include a treatment for rare earth permanent magnetic material consisting essentially of grains of the tetragonal crystal phase $RE_2TM_{14}$ B where RE is neodymium and/or praseodymium or mixtures thereof with other rare earth elements and TM is iron or mixtures of iron and cobalt. The methods incorporate soaking the magnetic material in a soaking solution containing distilled water or an aqueous solution of phosphoric acid and manganese phosphate, draining off the soaking solution, rinsing the magnetic material with distilled water while agitating to separate the magnetic material into a first, heavier portion which sinks to the bottom of the rinsing container and a second, less dense portion which floats on the top of the aqueous solution, and drying. The floating second portion is removed and the heavier first portion is dried to substantial dryness.

The basic method of treatment consists of soaking, washing, separating and drying cycles. The magnetic material may be in melt-spun ribbon form. The material is immersed in the soaking solution for about 5 to 20 minutes, and then drained off. Thereafter, rinsing the material with distilled water may be repeated up to 10 consecutive times before most of the material is separated. After separation, it is preferred to substantially dry the magnetic material to increase corrosion resistance.

Further in accordance with our treatment method, there is a specific embodiment useful for improving the magnetic properties of magnetic material. In this method, the rare earth permanent magnetic material is soaked in an aqueous solution of phosphoric acid and manganese phosphate for about 5 to 15 minutes. This solution is drained off and the magnetic material is thereafter rinsed with distilled water while agitating to allow any fine particles to float to the top of the rinsing solution. The rinsing water is drained off with the floating fine particles, leaving the heavier magnetic particles which have sunk to the bottom of the rinsing container. Rinsing and removal acts to separate the floating fine particles from the heavier magnetic material. This step may be repeated several times until substantially all of the finer, floating particles are removed, leaving the heavier particles at the bottoom of the rinse container. The remaining material is then dried to substantial dryness in air or at a slightly elevated temperature before the final processing. The dried heavier materials are the desired material particles which are then bonded or pressed into the permanent magnetic bodies.

The very fine particles which float to the top of the rinsing solution are comprised substantially of particles having a dimension of less than about 200 mesh size. The separation of the very fine particles from the heavier, larger particles occurs during the soaking and rinsing steps, and the rinsing step is repeated until the number of floating fine particles diminishes to a satisfactory level.

An advantage of our process is that the permanent magnetic bodies formed from the materials treated in the manner disclosed above exhibit enhanced magnetic properties, increased crush strength and an enhanced corrosion resistance due to their increased integrity. It is thought that the magnetic properties exhibited by magnets including the very fine particles are lower due to increased surface oxidation of the very fine particles. The particles remaining after the rinsing and separating steps described hereinabove may be bonded more effectively by epoxy because the very fine particles have been removed.

These and other objects and advantages of the invention will become more apparent from a detailed description thereof which follows.

BRIEF DESCRIPTION OF THE DRAWINGS

Reference will be made to the drawings, in which.

DETAILED DESCRIPTION OF THE INVENTION

Figure 1:
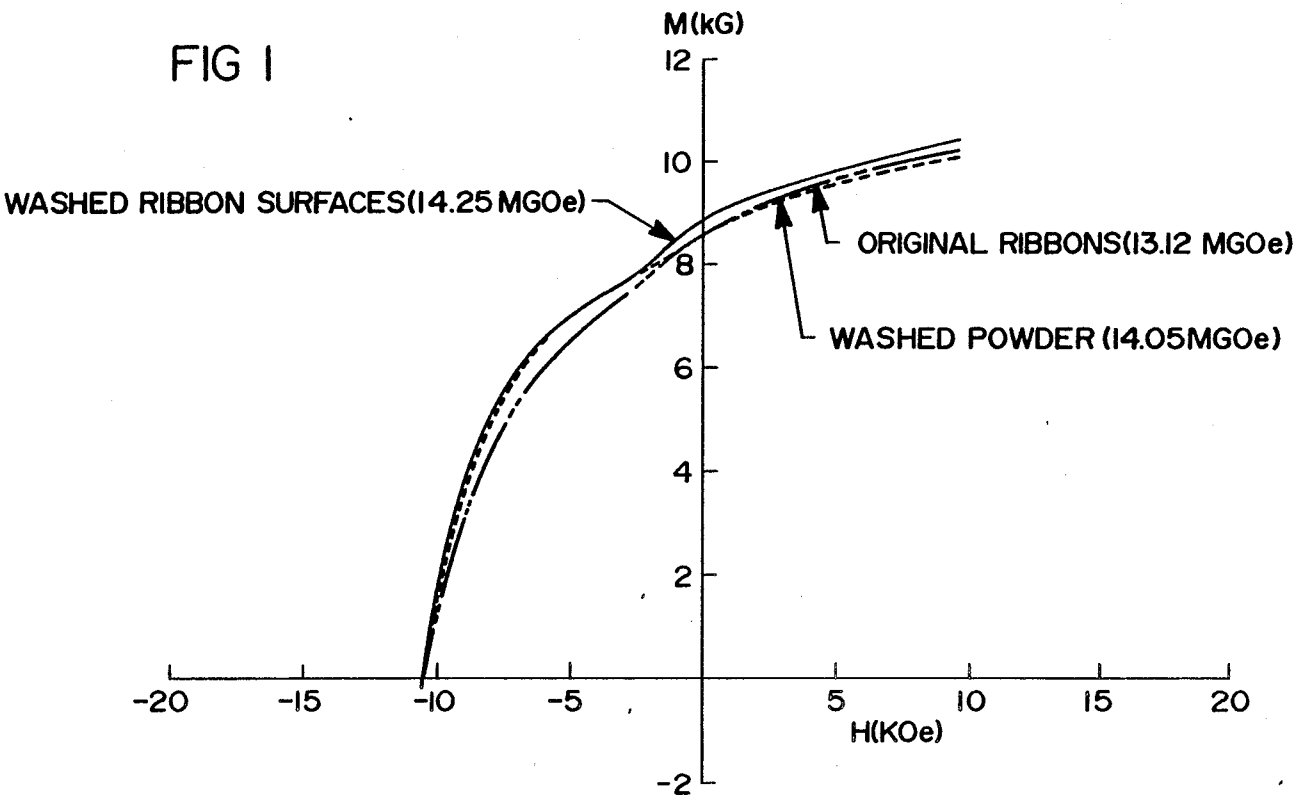
FIG. 1 is a demagnetization curve showing magnetic material subjected to a distilled water treatment, showing before and after treatment values.

Our method is useful in the treatment of rare earth permanent magnetic materials comprising a rare earth component, a suitable transition metal component and boron. Neodymium or praseodymium are essentially the rare earth components which are used in the rare earth permanent magnets. Their composition comprises from about 10 atomic percent to about 50 atomic percent of the rare earth component. Relatively small amounts of other rare earth elements, such as samarium, lanthanum, cerium, terbium and dysprosium, may be mixed with neodymium and praseodymium without any undesirable magnetic effects. It is preferable if these additives do not exceed 40 atomic percent of the rare earth component of the permanent magnetic material.

The preferred transition metal element is iron or iron combined with cobalt, nickel, chromium or manganese. Preferably, the composition comprises about 50 atomic percent to about 90 atomic percent of the transition metal component, that being iron, with the balance being made of the rare earth element(s) and between about 1 to about 10 atomic percent of boron. In summary, the overall composition may be expressed by the formula $RE_{1-x}(TM_{1-y}B)_x$ where the values of x and y are consistent with the above compositional limitations.

In practicing our method in accordance with our invention, the basic procedure which is followed includes (1) soaking the magnetic material in either pure distilled water, or an aqueous solution of manganese phosphate and phosphoric acid; (2) washing and rinsing the soaked material to remove the magnetic dust and very fine particles; and (3) drying the material before forming into permanent magnetic arcuates or other shapes. The specific details and compositions used will be discussed hereinbelow with relation to specific examples. These examples will further illustrate the practice of our invention, and will furthermore describe the results of our tests thereafter.

The permanent magnets used in the following examples were formed of particles made by melt spinning (or melt spinning and annealing) a molten iron-rare earth element-boron containing composition having a crystal grain size no greater than about 500 nanometers consisting essentially of grains of the tetragonal crystal phase $RE_1TM_{14}B$ where RE is neodymium and/or praseodymium or mixtures thereof with other rare earth elements, TM is iron or mixtures of iron and cobalt, and B is boron.

EXAMPLE 1 — REVITALIZATION

Example 1 was prepared from melt-spun magnetic material ribbons having a chemical composition of $$Nd_{0.13}(Fe_{0.94}B_{0.06})_{0.87}$$

by soaking in distilled water for 10 minutes. The soaking solution was drained off along with the very fine particles which floated to the top of the surface of the water. The resulting powder was rinsed and washed with additional distilled water five consecutive times. The total immersion time was approximately 15 minutes. The wet material which remained after the draining, washing and rinsing steps was then air dried.

The energy product of the original washed ribbon surfaces was 14.25 MGOe. Approximately two years later, the energy product of the original ribbons was 13.12 MGOe. After treating the melt-spun ribbons in accordance with the above-mentioned method, the magnetic properties obtained from washing only the surface yielded an energy product of 14.25 MGOe. The remanent moment and saturation were significantly increased. When the ribbons were reduced to a powdered state, the demagnetization curve showed an energy product of 14.05 MGOe. Therefore, a marked increase in magnetic behavior had occurred by revitalizing the material with the method of the present invention.

EXAMPLE 2 — PRECONDITIONING

A permanent magnet was prepared from a melt-spun ribbon of a molten mixture in accordance with the following formula:

$Nd_{0.144}(Fe_{0.944}B_{0.056})_{0.856}$

The ribbon was preconditioned prior to processing into the permanent magnet by soaking in a soaking solution of a 15:1 ratio of distilled water to undiluted Manganese Phospholene No. 7, a commercial rust remover solution available from Western Reserve Laboratories, Inc. This rust remover solution, as purchased, was analyzed by our laboratories and found to include manganese phosphate and about 20 percent by volume phosphoric acid.

The melt-spun ribbon material was soaked for 10 minutes in an open container and agitated. At the end of a 10 minute soaking period, the 15:1 soaking solution was drained off and the treated material was rinsed with distilled water four times. While rinsing, the magnetic material was agitated to allow the material to separate into a first, heavier portion which sunk to the bottom of the container, and a second, less dense portion which floated on top of the water rinse. The floating particles are very fine particles of less than about 200 mesh size. The fine particles are disposed of after each rinsing. The rinsing step was repeated four times until there were substantially no very fine particles left floating on the surface after the final rinse. The remaining, heavier portion was then air dried before being formed into a permanent magnet.

Figure 2A:
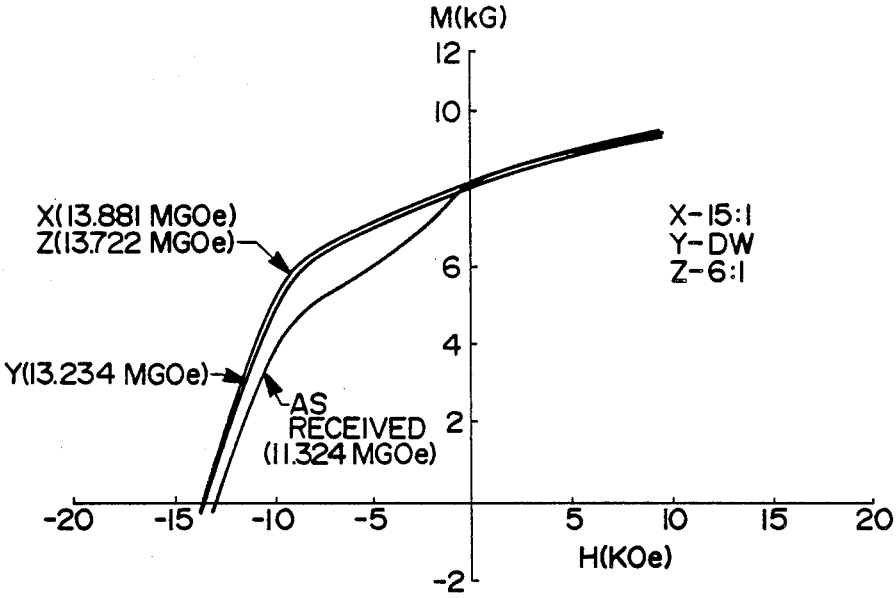
FIG. 2*a* is a series of M vs. H plots of magnetic material before and after being treated with the solutions described herein, illustrating the improved magnetic behavior.
Figure 2B:
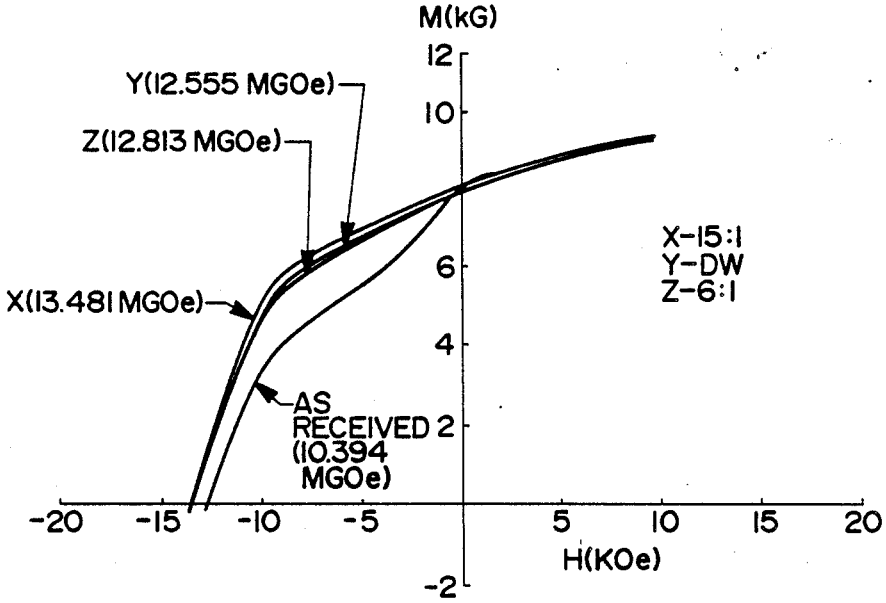
FIG. 2*b* is a series of M vs. H plots of another sample before and after treatment with the solutions described herein.

FIGS. 2(*a*) and 2(*b*) illustrate the magnetic behavior of the material prepared by this treatment. FIG. 2(*a*), curve X and FIG. 2(*b*), curve X show the energy product value after preconditioning, while the "as received" curves in FIGS. 2(*a*) and 2(*b*) show the energy product value before preconditioning. The material discussed herein as Example 2 is represented by the line illustrated in FIGS. 2(*a*) and 2(*b*) as Sample X (15:1). As can be seen by the Figures, before the conditioning, Sample X had an energy product in FIG. 2(*a*) of 11.324 MGOe and in FIG. 2(*b*) of 10.394 MGOe. After the treatment, the energy product of X in FIG. 2(*a*) was 13.881 MGOe and in FIG. 2(*b*) was 13.481 MGOe.

Furthermore, a common crush test strength for these magnetic materials was generally about 2700 pounds. When tested for crush strength, the magnetic sample treated by our method exhibited a crush strength of about 4800 pounds.

EXAMPLE 3 — PRECONDITIONING

Utilizing the same material as was used in Example 2, the preconditioning treatment was carried out with distilled water as the soaking solution instead of the manganese phosphate solution. Sample Y curves show the results of Example 3 after it was soaked for 15 minutes, while the remaining steps were carried out exactly as with Example 2. As can be seen from FIGS. 2(*a*) and 2(*b*), the material test results for the sample denoted as Y represent the results for this Example 3 and show increased magnetic behavior. FIG. 2(*a*) shows the Sample Y to have an "after" energy product of 13.234 MGOe, while the "before" value was 11.324 MGOe. FIG. 2(*b*) shows an "after" treatment value of 12.555 MGOe with a "before" value of 10.394 MGOe. This illustrates an increase in energy product of 1.91 MGOe in FIG. 2(*a*) and 2.16 MGOe in FIG. 2(*b*). During the crush test, Sample Y showed an average crush strength of 3940 pounds, rather than the 2700 pound crush strength test results of previous, non-preconditioned samples.

EXAMPLE 4 — PRECONDITIONING

Example 4 utilizes the same material as in the other Examples, although the preconditioning treatment was performed with a 6:1 ratio of distilled water to Manganese Phospholene No. 7 solution. Sample Z illustrated in FIGS. 2(*a*) and 2(*b*) represents the results of this Example 4 testing. As can be seen, Sample Z had a "before" energy product of 11.324 MGOe in FIG. 2(*a*) and 10.394 MGOe in FIG. 2(*b*) and an "after" energy product of 13.722 MGOe in FIG. 2(*a*) and 12.813 in FIG. 2(*b*), an increase of 2.398 MGOe in FIG. 2(*a*) and 2.419 MGOe in FIG. 2(*b*). Similar crush testing was performed on Sample Z and the resulting crush strength was an average of 4550 pounds.

Thus, our treatment of suitable transition metal, rare earth metal, and boron compositions yields magnetic products of superior permanent magnetic properties. For purposes of illustration, practice of our invention has been described using specific compositions of neodymium, iron, and boron. However, other materials may be substituted or may be present in suitably small amounts. Praseodymium may be substituted for neodymium or used in combination with it. Other rare earth metals may be used with neodymium and/or praseodymium. Likewise, other metals, such as cobalt, nickel, manganese and chromium, in suitably small amounts, may be used in combination with iron. The preferred compositional ranges are described above, as well as the essential tetragonal crystal phase grains forming particles having a crystal grain size no greater than about 500 nanometers.

Thus, our methods for treating melt-spun magnetic materials yield magnetically characterized products of excellent permanent magnetic properties. Again, for purposes of illustration, the practice of our invention has been described utilizing specific materials including neodymium, iron and boron compositions, although other magnetic materials may be treated by the method of the instant invention, to yield similarly suitable results.

While our invention has been described in terms of the preferred embodiments thereof, it will be appreciated that other embodiments could readily be adapted by those skilled in the art. Accordingly, the scope of our invention is to be considered limited only by the following claims.

The embodiments of the invention in which an exclusive property or privilege is claimed are defined as follows:

1. In the process of making permanent magnets by melt spinning a molten iron-rare earth element-boron containing composition to form particles having a crystal grain size no greater than about 500 nanometers and subsequently bonding or pressing the material into a permanent magnet body, the permanent magnet body consisting essentially of grains of the tetragonal crystal phase $RE_2TM_{14}B$ where RE is neodymium and/or praseodymium or mixtures thereof with other rare earth elements and TM is iron or mixtures of iron and cobalt, the improvement comprising:

soaking rare earth permanent magnetic material in distilled water;

draining off the soaking water and rinsing the magnetic material with more distilled water while agitating to separate the magnetic material into a first, heavier portion and a second, less dense portion by allowing the first heavier portion of the magnetic material to sink to the bottom of the container while allowing the second, lighter portion of the magnetic portion to float on top of the water rinse;

draining off the rinse water and the floating portion; and drying the remaining heavier portion of the treated magnetic material to substantial dryness.

2. The process of claim 1, wherein said soaking step is accomplished by soaking the magnetic material for about 15 minutes.

3. The process of claim 1, wherein said draining and rinsing step is repeated from about 2 to about 10 times.

4. The process of claim 1, wherein said drying step is accomplished by air drying.

5. In the process of making permanent magnets by melt spinning a molten iron-rare earth element-boron containing composition to form particles having a crystal grain size no greater than about 500 nanometers and subsequently bonding or pressing the material into a permanent magnet body, the permanent magnet body consisting essentially of grains of the tetragonal crystal phase $RE_2TM_{14}B$ where RE is neodymium and/or praseodymium or mixtures thereof with other rare earth elements and TM is iron or mixtures of iron and cobalt, the improvement comprising:

soaking rare earth permanent magnetic material in a solution containing phosphoric acid and manganese phosphate;

draining off the soaking solution;

rinsing the soaked magnetic material with distilled water while agitating to separate the magnetic material into a first heavier portion and a second, less dense portion by allowing the first heavier portion of the magnetic material to sink to the bottom of the container while allowing the second, less dense portion of the magnetic material to float on top of the water rinse;

draining off the rinse water and the floating portion; and drying the remaining heavier portion of the treated magnetic material to substantial dryness.

6. The process of claim 5, wherein said soaking step is accomplished by soaking the magnetic material for about 3 to about 15 minutes.

7. The process of claim 5, wherein said draining and rinsing step is repeated from about 2 to about 10 times.

8. The process of claim 5, wherein said drying step is accomplished by air drying.

9. In the process of making permanent magnets by melt spinning a molten iron-rare earth element-boron containing composition to form particles having a crystal grain size no greater than about 500 nanometers and subsequently bonding or pressing the material into a permanent magnet body, the permanent magnet body consisting essentially of grains of the tetragonal crystal phase $RE_2TM_{14}B$ where RE is neodymium and/or praseodymium or mixtures thereof with other rare earth elements and TM is iron or mixtures of iron and cobalt, the improvement comprising:

immersing the rare earth permanent magnetic material in a soaking solution containing chemical compounds selected from the group consisting of distilled water, manganese phosphate, phosphoric acid and mixtures thereof;

draining off the soaking solution;

rinsing the magnetic material with distilled water while agitating to separate the magnetic material into a first heavier portion which sinks to the bottom of the container, and a second, less dense portion which floats on top of the rinse water;

draining off the rinse water and the floating portion;

repeating the rinsing and draining steps from about 2 to about 10 times; and drying the first, heavier portion of the treated magnetic material to substantial dryness.

10. The process of claim 9, wherein said immersing step is accomplished by soaking the magnetic material from about 3 to about 15 minutes.

11. The process of claim 9, wherein said drying step is accomplished by air drying.

12. In the process of making permanent magnets by melt spinning a molten iron-rare earth element-boron containing composition to form particles having a crystal grain size no greater than about 500 nanometers and subsequently bonding or pressing the material into a permanent magnet body, the permanent magnet body consisting essentially of grains of the tetragonal crystal phase $RE_2TM_{14}B$ where RE is neodymium and/or praseodymium or mixtures thereof with other rare earth elements and TM is iron or mixtures of iron and cobalt, the improvement comprising:

immersing powdered rare earth permanent magnetic material in a phosphoric acid and manganese phosphate soaking solution;

draining off the soaking solution;

rinsing the magnetic material with distilled water while agitating to separate the magnetic material into a first heavier portion consisting of magnetic material particles which sink to the bottom of the container and a second, less dense portion of very fine particles of less than about 200 mesh size which float to the top of the rinse water;

draining off the rinse water and the floating fine particles of the powdered magnetic material on the top of the rinse water;

repeating the steps of rinsing and draining from about 2 to 10 times until there is a diminishing number of very fine particles floating on the rinse water surface; and air drying the first, heavier portion of the magnetic material to substantial dryness.

* * * * *